US005314548A

United States Patent [19]

Panchanathan et al.

[11] Patent Number: 5,314,548

[45] Date of Patent: May 24, 1994

[54] FINE GRAINED ANISOTROPIC POWDER FROM MELT-SPUN RIBBONS

[75] Inventors: Viswanathan Panchanathan, Anderson, Ind.; Gregory P. Meisner, Ann Arbor, Mich.; John J. Croat, Noblesville, Ind.

[73] Assignee: General Motors Corporation, Detroit, Mich.

[21] Appl. No.: 903,067

[22] Filed: Jun. 22, 1992

[51] Int. Cl.[5] ..... H01F 1/02

[52] U.S. Cl. ..... 148/101; 148/105; 148/122

[58] Field of Search ..... 148/101, 105, 122

[56] References Cited

U.S. PATENT DOCUMENTS

| | | | |
|---|---|---|---|
| 4,802,931 | 2/1989 | Croat | 148/302 |
| 4,842,656 | 6/1989 | Maines et al. | 148/302 |
| 4,851,058 | 7/1989 | Croat | 148/302 |
| 4,981,532 | 1/1991 | Takeshita et al. | 148/302 |
| 5,056,585 | 10/1991 | Croat | 164/463 |
| 5,110,374 | 5/1992 | Takeshita et al. | 148/101 |

FOREIGN PATENT DOCUMENTS

| | | | |
|---|---|---|---|
| 0304054 | 2/1989 | European Pat. Off. | |
| 61-270316 | 11/1986 | Japan | 148/105 |

OTHER PUBLICATIONS

Patent Abstracts of Japan, vol. 13, No. 359 (E-804), Aug. 10, 1989.

Doser et al., "Pulverizing Anistropic Rapidly Solidified Nd-Fe-B Materials for Bonded Magnets," Journal of Applied Physics, vol. 70, No. 10, Nov. 15, 1991, pp. 6603-6605.

*Primary Examiner*—John P. Sheehan

*Attorney, Agent, or Firm*—George A. Grove

[57] ABSTRACT

A method is disclosed for producing a rapidly solidified, fine grained, magnetically anisotropic powder of the RE-Fe-B type. The rapidly solidified material is optimally quenched or slightly overquenched and is subjected to a hydrogen absorption-hydrogen desorption process that produces a fine grained material containing the essential magnetic phase $RE_2TM_{14}B$ and an intergranular phase and is magnetically anisotropic.

6 Claims, No Drawings

FINE GRAINED ANISOTROPIC POWDER FROM MELT-SPUN RIBBONS

This invention pertains to rapidly solidified permanent magnet materials based on iron-neodymium-boron type compositions. More particularly, this invention relates to a method for treating such rapidly solidified (e.g., melt spun) materials so that the powders are magnetically anisotropic.

BACKGROUND OF THE INVENTION

Permanent magnets and magnetic materials based on iron, neodymium (and/or praseodymium) and boron are used worldwide in commercial applications, U.S. Pat. Nos. 5,110,374, 4,851,058 and 4,802,931 to Croat, for example, disclose a broad range of compositions that characterize the iron-neodymium-boron permanent magnet family. As indicated in these patents and in other publications, the magnets contain a transition metal (TM) component, usually iron or iron mixed with cobalt; a rare earth element (RE) component, usually neodymium including mixtures of neodymium with praseodymium and small amounts of the other rare earth group elements; and boron. As normally employed in commercial use, these compositions usually consist essentially, on an atomic percentage basis, of about 10 to 18 percent of the rare earth constituent, at least 60 percent of which is neodymium and/or praseodymium, a small amount up to about 10 percent boron, and the balance mainly iron or iron and cobalt. Preferably, these magnet compositions contain 70 percent or more of iron or iron and cobalt. The compositions may also contain small amounts of additives for processing or for the improvement of magnetic properties. They contain the tetragonal crystal phase $RE_2TM_{14}B$ where RE and TM are as indicated above and below.

Sintered versions of these magnetic materials have received wide commercial acceptance. Sintered magnets are made by preparing a crystalline powder or particles containing a grain of the tetragonal crystal phase $RE_2TM_{14}B$ a where RE is principally neodymium and/or praseodymium and TM is generally iron or iron and cobalt. The grains are typically one micrometer or larger such that the powder can be magnetically aligned, compacted into a green compact and sintered in vacuum or a nonoxidizing atmosphere. Sintering produces a fully dense body having magnetic coercivity. Such sintered permanent magnet is characterized by relatively large grains (i.e. greater than a few μm in diameter) of the 2-14-1 phase with an intergranular phase of a rare earth element content greater than the 2-14-1 phase.

U.S. Pat. Nos. 4,981,532 and 5,110,374 (Takeshita et al) disclose a practice of treating an ingot or a powder of large grained, polycrystalline material that includes the $RE_2Fe_{14}B$ phase. In the treatment, hydrogen is introduced into the polycrystalline material to form a the hydride(s). Subsequently, the hydride is decomposed and the hydrogen removed (desorbed) in older to recrystallize the 2-14-1 grain structure. In accordance with this practice, is possible to form a powder that is either magnetically isotropic or magnetically anisotropic. Thus, one starts with a material that is crystalline, contains grains of appreciable size (>1 μm) of the essential 2-14-1 phase and recrystallizes the grains so as to form usually smaller grains which may be aligned so as to constitute a magnetically anisotropic material.

There is also a substantial market for permanent magnet compositions of fine grain structure (<500 nm in average largest dimension) prepared starting with a melt spinning or other suitable rapid solidification process. The resultant powder can be used to make magnetically isotropic, resin-bonded magnets, as well as hot pressed and hot worked magnets.

The manufacture of rapidly solidified versions of the RE-TM-B family of permanent magnets starts with a molten alloy of suitable composition and produces melt-spun ribbon particle fragments. The rapid is solidification practice is usually carried out by containing the molten alloy in a heated vessel under a suitable nonoxidizing atmosphere. The molten alloy is ejected in a very fine stream from the bottom of the vessel through a small orifice onto the peripheral surface of a spinning, cooled quench wheel. The quench wheel is usually made of a suitable high-conductivity copper alloy and may have a wear-resistant coating on the circumferential quench surface of the wheel. The wheel is typically water cooled so that prolonged melt spinning production runs may be carried out without any unwanted decrease in the rate of heat extraction from the molten alloy that impinges upon the wheel. It is necessary to maintain a suitably high heat extraction rate in order to consistently obtain the desired very fine grain microstructure.

The rate of cooling of the molten alloy is dependent upon a number of factors such as the amount of superheat in the molten alloy, the temperature of the quench wheel, the rate of flow of the molten alloy through the orifice onto the spinning wheel, and the velocity of the peripheral surface of the spinning wheel. All other factors being considered, the most readily controlled parameter of the cooling of the molten alloy is the velocity of the peripheral surface of the quench wheel.

In the melt spinning of a specific composition, it is possible to obtain a range of permanent magnet properties in the melt-spun material by varying quench wheel speed. The phenomenon is well disclosed and described in U.S. Pat. Nos. 4,802,931, 4,851,058 and 5,056,585. As disclosed in these patents, by employing a given RE-TM-B composition and employing successively increasing quench wheel speeds starting with a relatively slow speed, it is possible to obtain a series of fine grained crystalline products that respectively display values of magnetic coercivity that continually increase toward a maximum value and then decrease from that value. At the same time the values of magnetic coercivity are increasing, the values of magnetic remanence also increase over at least a part of the increasing wheel speed range as the cooling rate is increased. In the manufacture of many members of the family of rapidly solidified RE-TM-B magnets, it is preferred to operate the quench wheel rate slightly faster than the wheel speed at which maximum coercivity is obtained in the melt-spun ribbon. These materials are then extremely fine grained or even apparently amorphous, and they can be annealed or hot worked to a condition of desired high coercivity and magnetic remanence.

Such melt-spun materials are magnetically isotropic. It would be advantageous to have a practice for the treatment of such extremely fine grained or amorphous materials which would produce magnetic anisotropy in such melt-spun ribbon particles. It has been possible in the prior art to produce magnetically anisotropic powder from a melt-spun ribbon material by producing overquenched, melt-spun ribbon, hot pressing the ribbon particles into a fully densified body, hot working the body to form elongated grains of magnetically anisotropic material, and pulverizing or comminuting the hot worked body to form the magnetically anisotropic powder. Such anisotropic powder has very good permanent magnet properties. However, it would be desirable to be able to produce a magnetically anisotropic material directly from (or in) the melt-spun ribbon particles.

Accordingly, it is an object of the present invention to provide a method of producing magnetically anisotropic powder material from a melt-spun powder that is initially very fine grained (typically less than 50 nanometers in grain size) or even apparently amorphous in its microstructure. It is a more specific object of the present invention to introduce such magnetically anisotropic properties into a melt-spun material by a practice of absorbing hydrogen into the fine grained material and then removing the hydrogen under conditions which produce a fine grain material having anisotropic magnetic properties.

In accordance with a preferred embodiment of our invention, these and other advantages are accomplished as follows.

BRIEF DESCRIPTION OF THE INVENTION

The practice of our invention is preferably applicable to a melt-spun material of the RE-TM-B type described that has been melt spun to an optimally quenched or to an overquenched condition. This is to say that the quench rate, typically through control of the wheel speed, is such that the coercivity of the as-quenched powder is optimal as is, or is less than could have been obtained using a somewhat lower wheel speed or lower cooling rate. The resulting material has a very fine grained microstructure of average grain size less than about 50 to 100 nanometers. It may even be substantially amorphous (i.e., have no readily perceptible crystallinity as indicated by x-ray diffraction pattern or by suitable microscopic technique such as transmission electron microscopy, TEM).

The practice of our invention is particularly applicable to those RE-TM-B compositions that contain, on an atomic percentage basis, about 10 to 16 percent rare earth element where at least 60 percent of the rare earth composition is neodymium and/or praseodymium. The compositions also preferably contain a small amount of boron up to about 10 atomic percent. The balance of the composition is substantially transition metal, preferably iron or iron with small amounts of cobalt (where cobalt is no more than 40 percent of iron plus cobalt). Preferably, the iron or iron plus cobalt content is at least 70 percent of the total composition. However, as will be disclosed, small amounts of additional alloying constituents may be employed to enhance the magnetically anisotropic characteristics of the final powder. Examples of such additives, usually employed in amounts of less than one percent by weight of the overall composition, include (alone or in combination) gallium, zirconium, carbon, tin, vanadium or tantalum.

While the Takeshita et al practice of U.S. Pat. Nos. 4,981,532 and 5,110,374 was successfully carried out by recrystallization of a polycrystalline large grained ingot material, we have discovered surprisingly that we can employ an analogous practice on essentially a nongranular material that will produce 2-14-1 grains (with an intergranular phase) that have sufficient alignment so as to display magnetic anisotropic properties.

Starting with an optimally quenched or overquenched melt-spun material, we subject pulverized ribbon fragments to hydrogen at a suitable elevated temperature under atmospheric pressure or slightly subatmospheric pressure for a brief period of time so as to form hydrides of the iron and rare earth constituents. We then evacuate hydrogen from the environment around the powder and totally withdraw (or desorb) it. The hydrogenation and dehydrogenation is preferably carried out at a temperature in the range of about 700° C. to 850° C. The period of hydrogenation and the period for hydrogen removal are both on the order of one hour or less. Upon removal of the hydrogen from the solid material and cooling to room temperature, we find that we have produced a fine grained material less than about 500 nanometers, preferably less than 300 nanometers, in average dimension. The microstructure consists essentially of such fine grains of the $RE_2Fe(Co)_{14}B$ tetragonal crystal phase with a rare earth element-rich grain boundary phase about each of the tetragonal grains. Surprisingly, the resultant material when pulverized to a powder can be aligned in a magnetic field and hot pressed or consolidated with a resinous bonding agent or other suitable binding material to produce a magnet which has preferred magnetic boundaries in the properties of magnetic alignment.

While our invention has been described in terms of preferred embodiments thereof, other objects and advantages of our invention will become more clearly apparent from a detailed description thereof which follows.

DETAILED DESCRIPTION OF SPECIFIC EMBODIMENTS

EXAMPLE 1

We prepared an alloy of the following composition on a weight percent basis: Total rare earth content, 31.2 percent (of which 95 percent was neodymium, about 4 percent was praseodymium, and the balance incidental impurity amounts of other rare earths; cobalt, 2.5 percent; boron, 0.94 percent; gallium, 0.5 percent; and zirconium, 0.08 percent, with the balance iron and incidental impurities such as aluminum, silicon, carbon and the like. Expressed in terms of atomic proportions, the RE content was about 14.5 percent, the cobalt content about 2.5 percent, boron about 6 percent, gallium about 0.5 percent, zirconium about 0.08 percent and the balance iron. This molten alloy material was inductively heated in a quartz crucible to a temperature of 1420° C. in a dry, substantially oxygen-free atmosphere. The material was ejected under a slight pressure (3 psig) of argon atmosphere through a 0.025 inch diameter orifice in the bottom of the crucible onto the circumferential edge of a 10 inch diameter copper quench wheel. The material was melt spun in portions at a variety of wheel speeds ranging from 13 meters per second to 24 meters per second. In the Table 1 below, the demagnetization properties of the as-melt-spun material at the respective wheel speed is summarized.

TABLE 1

| Wheel Speed (m/sec) | $B_r$ (kG) | $H_{ci}$ (kOe) | $BH_{max}$ (MGOe) |
|---|---|---|---|
| 13 | 7.22 | 17.70 | 10.81 |
| 15 | 7.26 | 17.80 | 11.0 |
| 17 | 7.53 | 17.96 | 12.0 |
| 20 | 5.19 | 11.92 | 3.91 |
| 22 | 3.18 | 2.38 | 0.99 |

TABLE 1-continued

| Wheel Speed (m/sec) | $B_r$ (kG) | $H_{ci}$ (kOe) | $BH_{max}$ (MGOe) |
|---|---|---|---|
| 24 | 1.39 | 0.53 | 0 |

It is seen that by varying the wheel speed with the other parameters of the apparatus that affect rate of cooling substantially constant, a range of magnetic properties is obtained. This range is characterized by an increasing coercivity with increasing wheel speed to a maximum coercivity and substantially maximum remanence values at a wheel speed of about 17 meters per second. Thereafter, the permanent magnet properties decrease as the cooling rate increases. This is due to the fact that as the cooling rate increases, the rapidly solidified material becomes a finer and finer grain size and reaches a near amorphous condition at the higher wheel speeds. We prefer to practice the process of this invention on the optimally or overquenched materials. In other words, we prefer to apply the practice in the case of this example to material that has been melt spun at a wheel speed of 17 meters per second or greater (up to about 24 m/sec).

We then subjected the melt-spun samples produced at the various wheel speeds to a hydrogen absorption-desorption practice as follows. A sample was placed in a furnace initially at ambient temperature. The furnace was evacuated of air and backfilled with hydrogen to a pressure of about 650 torr. The contents of the furnace were heated to 800° C. over a period of 35 minutes. The melt-spun sample in the hydrogen atmosphere was maintained at 800° C. for three minutes. The hydrogen was then pumped out of the furnace utilizing a vacuum pump with the pumping continuing so as to reach a pressure of $10^{-2}$ torr. The desorption step at a temperature of about 800° C. was continued for 10 minutes, and then the treated melt-spun ribbon particles were removed from the furnace and were cooled to room temperature within 10 minutes under vacuo. The ribbon particles had retained their shape. They had not been comminuted by the hydrogen treatment process.

This described process of hydrogen absorption-desorption was chosen as a result of some experimentation on a variety of melt-spun samples. In general, we prefer to carry out the hydrogen absorption on our melt-spun material at a subatmospheric hydrogen pressure above about 600 torr. A pressure of about 650 torr is preferred. Hydrogenation temperatures in the range of about 700° C. to 850° C. are preferred, with hydrogenation times up to one hour being suitable. Thereafter, we maintained the sample for an additional period of up to one hour during hydrogen desorption. We prefer to continually pump the hydrogen from the furnace by evacuating the furnace to a pressure of $10^{-2}$ torr or less. The ribbon particles are then comminuted to a powder of suitable size for further processing into resin-bonded or hot pressed magnets. Very fine particle sizes, e.g., −500 mesh, show greater magnetic anisotropy but tend to show reduced values of coercivity.

The results of the above specific hydrogen absorption-hydrogen desorption practice are summarized in the following Table 2. The data summarized is a result of aligning the treated hydrogen and desorbed powder of 325 mesh (obtained by crushing the ribbon particles) in a magnetic field of 18 kiloOersted strength. The magnetization-demagnetization properties of the aligned powder were then measured in a direction parallel to the direction of alignment and in a direction transverse or perpendicular to the direction of alignment. The demagnetization properties are summarized in the following Table 2 for the respective melt-spun samples.

TABLE 2

| Wheel Speed | $B_r$ (kG) | | $H_{ci}$ (KOe) | | $BH_{max}$ (MGOe) | |
|---|---|---|---|---|---|---|
| (m/sec) | Parallel | Perpendicular | Parallel | Perpendicular | Parallel | Perpendicular |
| 17 | 7.86 | 6.85 | 13.25 | 13.62 | 13.3 | 9.80 |
| 20 | 7.78 | 6.84 | 12.86 | 13.25 | 12.59 | 9.63 |
| 22 | 7.70 | 6.93 | 13.64 | 13.92 | 12.51 | 10.02 |
| 24 | 7.78 | 6.76 | 12.73 | 13.06 | 12.89 | 9.44 |

It is seen by examination of the magnetic properties summarized in the above table that each of the rapidly solidified materials that were subjected to hydrogen absorption-hydrogen desorption yielded a permanent magnet material that displayed preferred or stronger magnetic properties in the direction parallel to the direction of original particle alignment. In other words, the material displayed magnetic anisotropy. The average grain size of the material was about 250 to 300 nanometers as detected by transmission electron microscopy (TEM). We prefer that the average grain size of our product be no greater than about 500 nanometers. As a result, our rapidly solidified, magnetically anisotropic material is suitable for many applications that require slightly higher properties than the magnetically isotropic form of the rapidly solidified, permanent magnet material.

EXAMPLE 2

We prepared alloys of the following compositions for melt spinning into an overquench condition and for subsequent processing by the hydrogen absorption-hydrogen desorption process. The several alloys were composed as follows where TRE stands for total rare earth content consisting of about 95 percent by weight neodymium, 5 percent praseodymium and the balance trace amounts of other rare earth elements. The following are on a weight percent basis.

E alloy contained 30.5 percent TRE, 2.5 percent cobalt, 0.95 percent boron and the balance iron.

Alloy 223 contained 31.3 percent TRE, 2.5 percent cobalt, 0.91 percent boron, 0.17 percent tin and the balance iron.

Alloy 364 contained 31.3 percent TRE, 2.5 percent cobalt, 0.84 percent boron, 0.08 percent niobium and the balance iron.

Alloy 320 contained 30.0 percent TRE, 2.5 percent cobalt, 0.95 percent boron, 0.84 percent vanadium and the balance iron.

Alloy 374 contained 30.1 percent TRE, 2.5 percent cobalt, 1.0 percent boron, 0.49 percent gallium, 0.10 percent tantalum and the balance iron.

Each of these materials was melt spun as described in Example 1 above. Each was melt spun at a wheel speed of 20 meters per second so as to produce an overquenched material. The overquenched samples were successively subjected to a hydrogen absorption-hydrogen desorption process exactly like the specific practice described in Example 1. Following cooling from the hydrogen desorption step, powdered materials were aligned in a magnetic field and their magnetic properties measured. The properties are summarized in the following Table 3.

TABLE 3

| | $B_r$ (kG) | | $H_{ci}$ (KOe) | | $BH_{max}$ (MGOe) | |
|---|---|---|---|---|---|---|
| Alloy | Parallel | Perpendicular | Parallel | Perpendicular | Parallel | Perpendicular |
| E | 7.33 | 6.63 | 11.74 | 11.92 | 10.87 | 9.26 |
| 223 | 7.84 | 6.89 | 11.91 | 12.29 | 11.85 | 9.56 |
| 364 | 7.18 | 6.64 | 12.88 | 13.03 | 10.29 | 8.83 |
| 320 | 7.44 | 6.64 | 12.94 | 13.04 | 11.73 | 9.91 |
| 374 | 7.58 | 6.94 | 12.40 | 12.67 | 11.52 | 9.68 |

It is seen that each of the above compositions displayed magnetic anisotropy after being processed by the hydrogen absorption-hydrogen desorption process. It is seen that alloy 223 containing a small amount of tin, alloy 320 containing a small amount of vanadium and alloy 374 containing small amounts of gallium and tantalum displayed stronger magnetic properties than alloy E with no additives other than the basic iron-cobalt-rare earth-boron composition or alloy 364 containing a small amount of niobium.

Thus, in general, our practice is applicable to optimally quenched or overquenched materials based on the RE-TM-B system. We are able to obtain a fine grained (preferably less than about 300 nanometers in average largest dimension, suitably no greater than about 500 nanometers) magnetically anisotropic material. This has been accomplished by absorbing hydrogen into metal particles that do not contain large grains of the 2-14-1 phase. Indeed, the starting material consists of material that is extremely fine grained or material in which identifiable grains are not readily observable. Our rapidly quenched material is usually characterized by an x-ray diffraction pattern with diffuse or no peaks; in other words, a pattern that is characteristic of an extremely fine grained or amorphous material. Upon hydrogenation, if the material is quenched to freeze the microstructure and an x-ray diffraction pattern produced, diffraction peaks characteristic of neodymium hydride, iron boride and alpha iron are observed. There is no semblance of the essential 2-14-1 phase for permanent magnet properties in the hydrogenated structure. Following hydrogen desorption and the heat treatment that is concomitant with the hydrogen absorption and desorption steps, very small grains of the 2-14-1 phase, preferably less than about 300 nanometers in average greatest dimension, are detected by TEM. Also detectable by TEM is a rare earth element-rich grain boundary phase around the 2-14-1 grains which contributes to the coercivity of the material.

Thus, in summary, we employ a practice of rapidly absorbing hydrogen into a rapidly solidified, fine grained material at a suitable temperature, preferably of the order of 700° C. to 850° C. without inducing rapid grain growth of the material. After a brief period of hydrogen absorption, typically less than one hour, the hydrogen is removed from the material as rapidly as practical. This process is also preferably carried out at a temperature of the order of 700° C. to 850° C. The hydrogen is removed in a matter of minutes, preferably less than 60 minutes. The dehydrogenated material is then rapidly cooled to room temperature such as by backfilling the furnace with argon so as to retain the necessary fine grain character of the material.

Our magnetically anisotropic powder will usually be magnetically aligned and bonded or formed into a permanent magnet body of desired shape. There are known practices to form such permanent magnets. Our hydrogen treated-hydrogen desorbed particles may be reduced to a suitable particle size for the shaping of the desired magnet configuration. Typically, the particles will be mixed with or coated (encapsulated) with a suitable bonding resin(s), stabilizers and the like. The particles may also be aligned and hot pressed to a fully dense, anisotropic permanent magnet.

While our invention has been described in terms of a specific embodiment thereof, it will be appreciated that other forms could readily be adapted by those skilled in the art. Accordingly, the scope of our invention is to be considered limited only by the following claims.

The embodiments of the invention in which an exclusive property or privilege is claimed are defined as follows:

1. A method of making fine grained, magnetically anisotropic permanent magnet powder particles consisting essentially of grains of the tetragonal crystal phase $RE_2(Fe_xCo_{1-x})_{14}B_1$ with an intergranular phase surrounding the grains, where RE represents one or more rare earth elements including at least 60 percent neodymium and/or praseodymium, the value of x is in the range of 0.6 to 1, and the composition of the intergranular phase is richer in rare earth element content than the tetragonal crystal phase, the composition of said powder being further characterized in that in molten precursor form, it is susceptible to being rapidly cooled to solidification over a determinable and controllable range of cooling rates within which range a series of fine grained crystalline products is formed that respectively display (a) values of magnetic coercivity that continually increase toward a maximum value and decrease from such value as the cooling rate is increased and (b) values of magnetic remanence that increase over at least a part of such range as the cooling rate is increased, said method comprising rapidly solidifying a said molten precursor composition at a maximum coercivity value cooling rate or greater to form fine-grained particles in which the average grain size is no greater than about 100 nanometers, heating said rapidly solidified particles in a hydrogen atmosphere at a pressure no greater than atmospheric pressure at a temperature for forming metal hydrides in the particles, and thereafter removing hydrogen from the particles and cooling the particles to provide said magnetically anisotropic powder, the time and temperature of hydrogen treatment and removal being such that the average grain size of the 2-14-1 phase is no greater than 500 nanometers.

2. A method of making fine-grained, magnetically anisotropic permanent magnet powder particles comprising, on an atomic percentage basis, 10 to 18 percent of a rare earth element including at least 60 percent neodymium and/or praseodymium, 0.5 to 10 percent boron, and at least 70 percent iron or mixtures of iron with cobalt, the composition of said powder being further characterized in that in molten precursor form, it is susceptible to being rapidly cooled to solidification over a determinable and controllable range of cooling rates within which range a series of fine grained crystalline products is formed that respectively display (a) values of magnetic coercivity that continually increase toward a maximum value and decrease from such value as the cooling rate is increased and (b) values of magnetic remanence that increase over at least a part of such range as the cooling rate is increased, said method comprising rapidly solidifying a said molten precursor composition at a maximum coercivity value cooling rate or greater to form fine-grained particles in which the average grain size is no greater than about 100 nanometers.

heating said rapidly solidified particles in a hydrogen atmosphere at a pressure no greater than atmospheric pressure at a temperature for forming metal hydrides in the particles, and thereafter removing hydrogen from the particles and cooling the particles to provide said magnetically anisotropic powder, the time and temperature of hydrogen treatment and removal being such that the material consists essentially of the tetragonal crystal phase $RE_2(Fe_xCo_{1-x})_{14}B_1$ with an intergranular phase surrounding the grains, where RE represents one or more rare earth elements including at least 60 percent neodymium and/or praseodymium, the value of x is in the range of 0.6 to 1, and the composition of the intergranular phase is richer in rare earth element content than the tetragonal crystal phase, and the average grain size of the 2-14-1 phase is no greater than 500 nanometers.

3. A method of making fine-grained, magnetically anisotropic permanent magnet powder particles consisting essentially of grains of the tetragonal crystal phase $RE_2(Fe_xCo_{1-x})_{14}B_1$ with an intergranular phase surrounding the grains, where RE represents one or more rare earth elements including at least 60 percent neodymium and/or praseodymium, the value of x is in the range of 0.6 to 1, and the composition of the intergranular phase is richer in rare earth element content than the tetragonal crystal phase, the composition of said powder being further characterized in that in molten precursor form, it is susceptible to being rapidly cooled to solidification over a determinable and controllable range of cooling rates within which range a series of fine grained crystalline products is formed that respectively display (a) values of magnetic coercivity that continually increase toward a maximum value and decrease from such value as the cooling rate is increased and (b) values of magnetic remanence that increase over at least a part of such range as the cooling rate is increased, said method comprising rapidly solidifying a said molten precursor composition at a maximum coercivity value cooling rate or greater to form fine-grained particles in which the average grain size is no greater than about 50 nanometers, heating said rapidly solidified particles in a hydrogen atmosphere at a pressure in the range of about 600 to 760 torr at a temperature in the range of 700° C. to 850° C. for forming metal hydrides in the particles, and thereafter removing hydrogen from the particles and cooling the particles to provide said magnetically anisotropic powder, the time and temperature of hydrogen treatment and removal being such that the average grain size of the 2-14-1 phase is no greater than 300 nanometers.

4. A method as recited in claim 1 where the rapidly solidified composition comprises at least one additive selected from the group consisting of carbon, gallium, tantalum, tin, vanadium and zirconium.

5. A method as recited in claim 2 where the rapidly solidified composition comprises at least one additive selected from the group consisting of carbon, gallium, tantalum, tin, vanadium and zirconium.

6. A method as recited in claim 3 where the rapidly solidified composition comprises at least one additive selected from the group consisting of carbon gallium, tantalum, tin, vanadium and zirconium.

* * * * *